US006230878B1

(12) United States Patent
Lehr

(10) Patent No.: US 6,230,878 B1
(45) Date of Patent: May 15, 2001

(54) PERSONALIZED RUBBER BANDED CARD AND CURRENCY HOLDER

(76) Inventor: Barbara C. Lehr, 44 Doyle St., Long Beach, NY (US) 11561

( * ) Notice: Subject to any disclaimer, the term of this patent is extended or adjusted under 35 U.S.C. 154(b) by 0 days.

(21) Appl. No.: 09/566,955

(22) Filed: May 8, 2000

(51) Int. Cl.[7] ..... A45C 11/00
(52) U.S. Cl. ..... 206/37; 24/17 B
(58) Field of Search ..... 206/37, 232, 451, 206/459.5, 449, 805; 150/137, 147; 24/17 B, 3.12, 301

(56) References Cited

U.S. PATENT DOCUMENTS 1,613,380 * 1/1927 Broomhall .
1,619,644 * 3/1927 Wetzel .
1,915,213 * 6/1933 Brenner .
1,960,690 * 5/1934 Blair .
3,712,463 * 1/1973 Bestehorn .
5,054,816 * 10/1991 Rosengarten .
5,279,019 * 1/1994 Knickle .
5,351,017 * 9/1994 Yano et al. .
5,520,230 * 5/1996 Sumner, III .
5,944,080 * 8/1999 Podwika .

* cited by examiner

*Primary Examiner*—David T. Fidei
(74) *Attorney, Agent, or Firm*—Myron Amer PC

(57) ABSTRACT

An assembled article of manufacture for rubber-banding credit cards and folded paper currency in which only initially a rubber band is stretched to undergo a necking down to facilitate insertion into opposite peripheral compartments of a personalized or otherwise inscribed cooperating metal component and the assembly completed by the release of the rubber band which assumes its unstretched thickness within the peripheral compartments. Thereafter stretching of the rubber band about an assemblage of the credit cards and/or paper currency bulk, or both, does not disassemble the metal component and the rubber band.

2 Claims, 1 Drawing Sheet

PERSONALIZED RUBBER BANDED CARD AND CURRENCY HOLDER

The present invention relates generally to improvements in articles of manufacture of the type used as money and credit card holders, the improvements more particularly contributing to personalizing of holder to correspondingly contribute to its gift value, as for a birthday, anniversary or like occasions.

EXAMPLES OF THE PRIOR ART

It is known from common experience that preparatory to using a specific credit card or dispensing a specific denomination of paper currency, the locating of the credit card or the paper bill is made more convenient if made from an assemblage of credit cards or paper currency in which the credit card or paper bill is known to exist. Thus, in the prior patents, there is disclosed and illustrated numerous articles of manufacture which limit the searching for a credit card or paper bill to a single assemblage thereof, such prior patents being exemplified by U.S. Pat. No. 5,944,080 for "Money And Card Holder" issued to Podwika on Aug. 31, 1999, U.S. Pat. No. 5,520,230 for "Pocket Card Holder With Money Clip" to Summer, III on May 28, 1996, U.S. Pat. No. 1,915,213 for "Card Case" to Brenner on May 24, 1932, and U.S. Pat. No. 1,613,380 for "Card Case" issued to Broomhall on Nov. 27, 1925. The sampling of prior patents just provided, and particularly including the '380 patent, is because a closed loop of a rubber band is readily identifiable as a component thereof.

In the patented articles of manufacture noted, and in all other known similarly manufactured articles, the closed loop rubber band is undoubtedly perceived as a component so commonplace as to be devoid of gift value and, consequently, requiring cooperating structural components to make up for the deficiency of gift value. Stated somewhat otherwise, the prior art instructs that the rubber band has to be significantly embellished to qualify as a birthday, anniversary, retirement, or other special occasion gift.

Broadly, it is an object to provide a noteworthy gift or manufacture serving as a holder for credit cards and/or folded paper currency that is rubber-banded without the significant embellishment shortcoming of the prior art.

More particularly, it is an object to use to advantage the construction material of the rubber band to achieve an assembly thereto of a component having a personalizing relation to the intended recipient, so that the assembly has significant gift value, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

It is known from common experience that individuals carry on their person paper currency A and plastic credit cards B using a wallet which a man typically will place in a clothing pocket and a women in her purse. Eschewing the use of a wallet, many individuals will simply stretch a rubber band about a stack of the credit cards or about a bulk of paper currency folded in half, or about a combination of the two. Taking the case of the credit cards to exemplify the present invention, the folded paper currency being substantially similarly handled, the mere rubber-banding of the credit cards does not contribute to any novelty as would qualify it as a gift item.

Figure 1:
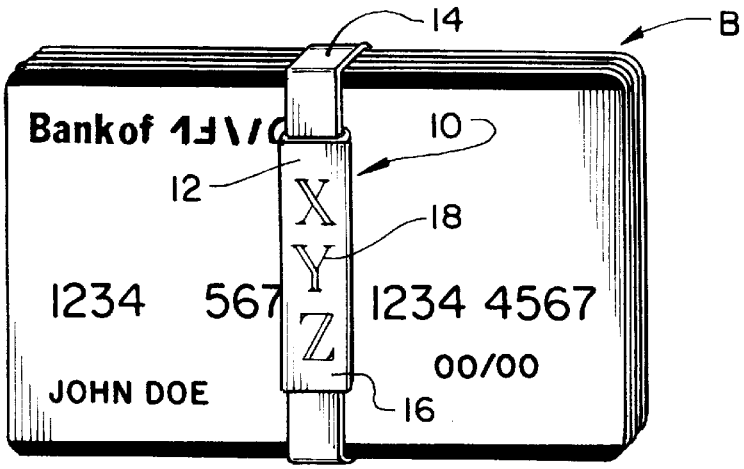
FIG. 1 is a front perspective view of a stack of credit cards rubber-banded according to the present invention.
Figure 2:
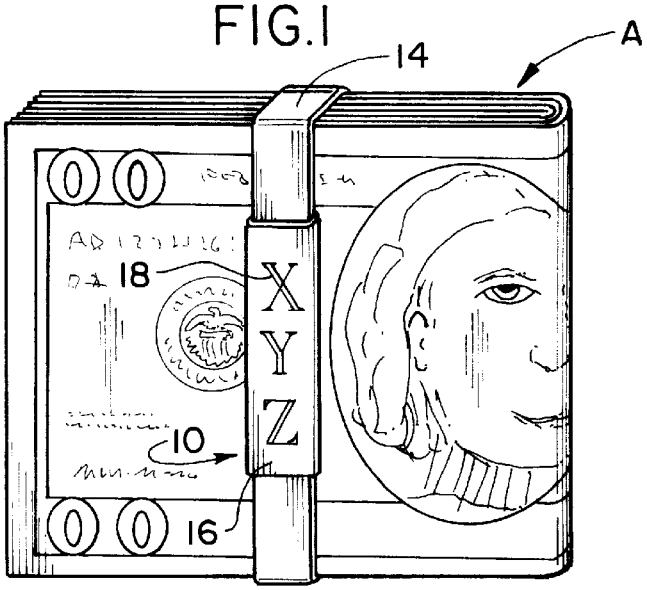
FIG. 2 is a view similar to FIG. 1 but illustrating the rubber-banding of paper currency.
Figure 4:
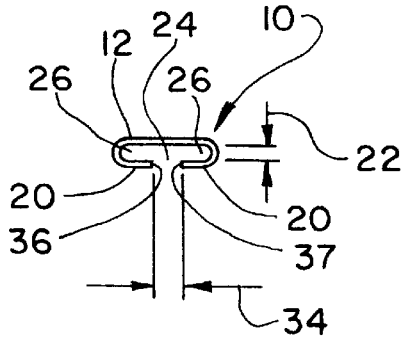
FIG. 4 is a side elevational view of the slide component as seen in the direction of lines 4—4 of FIG. 3.
Figure 3:
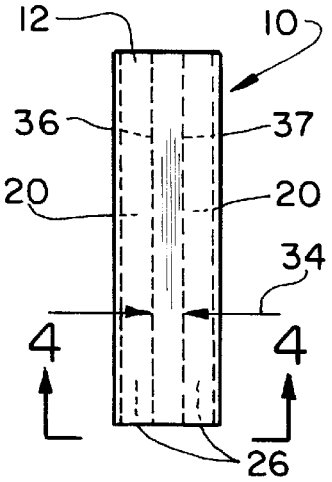
FIG. 3 is an isolated top view of a slide component illustrated in assembled relation to the rubber band in FIGS. 1, 2.
Figure 5:
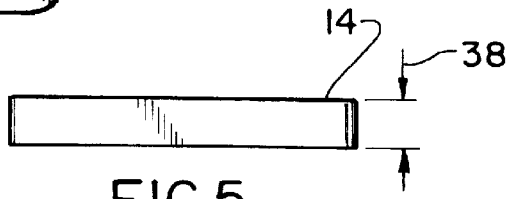
FIG. 5 is an isolated top view of the rubber band of FIGS. 1, 2.
Figure 6:
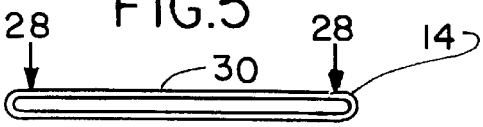
FIG. 6 is a side elevational view of a length portion of the rubber band in an unstretched condition.
Figure 7:
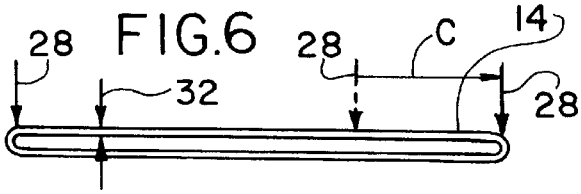
FIG. 7 is a view similar to FIG. 6 but illustrating the length portion in a stretched condition.

To rectify this shortcoming, there is provided in accordance with the present invention a slide (because it "slides" if need be on the rubber band for positioning) of sterling silver or 14 carat gold construction material, known to be amendable to being engraved or etched, or the like. Slide 10 to serve the purpose of personalizing the rubber-banded credit cards of FIG. 1 has a central wall 12 in covering relation over the rubber band 14 to serve as a display background 16 for the monogram or like inscription 18 and opposite sides bent behind the wall 12, as at 20, with a clearance 22 which bounds an opening 24 into lengthwise oriented compartments 26. The clearance 22 is selected to be nominal in size for proper fit of the slide 10 on the rubber band 14, but assembly is nevertheless readily achieved by using to advantage the elastomeric construction of the rubber band.

More particularly, the user grips the rubber band at spaced part locations 28 on opposite sides of a length portion 30 and stretches the length portion longitudinally. As known, the stretching C causes the thickness 32 of the unstretched length portion 30 to "neck down" to a diminished dimensioned thickness which it will be understood is of a size that readily slips through the compartment openings 24. The distance 34 between the edges 36, 37 of the bent sides 20 is selected to be less than the width 38 of the rubber band 14 so that the procedure in assembling the slide 10 to the rubber band 14 entails slipping into place one stretched rubber band within edge 36 and then the opposite stretched rubber band within edge 37 which is in an immediately adjacent overlying location to a cooperating compartment opening 26. The assembly of the components can be achieved with or without assistance.

In practice, good results have been achieved using a rubber band measured in the flat having a non-stretched length of 1¼ inches and graded in the trade as a number 62. The preferred length of the slide is 1⅜ inches.

While the article of manufacture herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claim:

1. A combination article of manufacture comprising:

(a) an assemblage of pocket-sized credit cards approximately 2 inches by 3¼ inches of a rectangular shape-imparting construction material, and attached about said assemblage (b) a sized rubber band in encircling relation widthwise of said assemblage;

(c) a slide having an operative position slidably disposed on said rubber band, said slide
  (i) being constituted of metal construction material of a type permitting an engraving thereof, and
  (ii) consisting of a body having a wall in said slide operative position overlying said rubber band, and
  (iii) said wall being in an outwardly facing relation so as to serve as a display surface;

(d) reversibly bent longitudinally oriented length portions of said slide operatively disposed behind peripheral edges of said rubber band
  (i) so as to bound rubber band-receiving compartments, and
  (ii) having nominally sized openings into said compartments; and (e) incident to said slide being operatively positioned on said rubber band, said rubber band being stretched lengthwise to neck down to a thickness thereof sized to allow said rubber band peripheral edges to be urged in movement through said compartment openings into said compartments to complete an assembly of said article of manufacture, whereby an engraving of said display surface is adapted to contribute to a value of said article of manufacture being personalized.

2. A combination article of manufacture comprising:

(a) an assemblage of folded paper currency of a rectangular shape, and attached about said assemblage (b) a sized rubber band in encircling relation widthwise of said assemblage;

(c) a slide having an operative position slidably disposed on said rubber band, said slide
  (i) being constituted of metal construction material of a type permitting an engraving thereof, and
  (ii) consisting of a body having a wall in said slide operative position overlying said rubber band, and
  (iii) said wall being in an outwardly facing relation so as to serve as a display surface;

(d) reversibly bent longitudinally oriented length portions of said slide operatively disposed behind peripheral edges of said rubber band
  (i) so as to bound rubber band-receiving compartments, and
  (ii) having nominally sized openings into said compartments; and (e) incident to said slide being operatively positioned on said rubber band, said rubber band being stretched lengthwise to neck down to a thickness thereof sized to allow said rubber band peripheral edges to be urged in movement through said compartment openings into said compartments to complete an assembly of said article of manufacture, whereby an engraving of said display surface is adapted to contribute to a value of said article of manufacture being personalized.

* * * * *

US006230878C1

(12) EX PARTE REEXAMINATION CERTIFICATE (9810th)

United States Patent
Lehr

(10) Number: US 6,230,878 C1
(45) Certificate Issued: Aug. 26, 2013

(54) PERSONALIZED RUBBER BANDED CARD AND CURRENCY HOLDER

(75) Inventor: Barbara C. Lehr, Long Beach, NY (US)

(73) Assignee: J Lea, LLC, Hollywood, FL (US)

Reexamination Request:
No. 90/012,100, Feb. 7, 2012

Reexamination Certificate for:

| | |
|---|---|
| Patent No.: | **6,230,878** |
| Issued: | **May 15, 2001** |
| Appl. No.: | **09/566,955** |
| Filed: | **May 8, 2000** |

(51) Int. Cl.
*A45C 1/00* (2006.01)

(52) U.S. Cl.
USPC ..... 206/37; 24/17 B

(58) Field of Classification Search
None
See application file for complete search history.

(56) References Cited

To view the complete listing of prior art documents cited during the proceeding for Reexamination Control Number 90/012,100, please refer to the USPTO's public Patent Application Information Retrieval (PAIR) system under the Display References tab.

*Primary Examiner* — Robert M. Fetsuga

(57) ABSTRACT

An assembled article of manufacture for rubber-banding credit cards and folded paper currency in which only initially a rubber band is stretched to undergo a necking down to facilitate insertion into opposite peripheral compartments of a personalized or otherwise inscribed cooperating metal component and the assembly completed by the release of the rubber band which assumes its unstretched thickness within the peripheral compartments. Thereafter stretching of the rubber band about an assemblage of the credit cards and/or paper currency bulk, or both, does not disassemble the metal component and the rubber band.

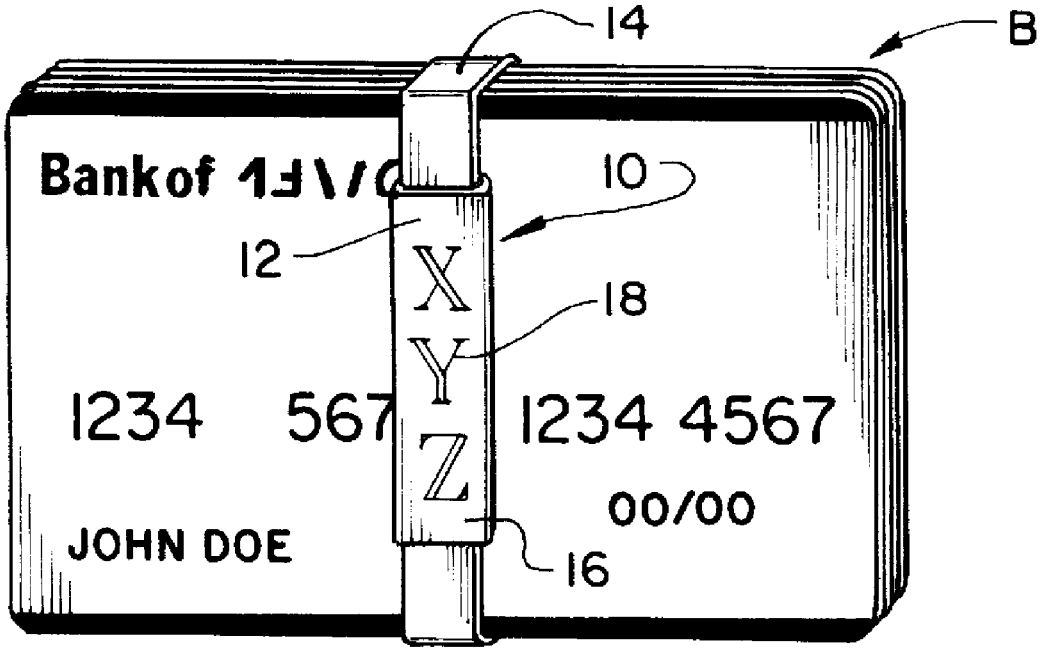

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *